US011459211B2

(12) United States Patent
Ichihara et al.

(10) Patent No.: US 11,459,211 B2
(45) Date of Patent: Oct. 4, 2022

(54) NARROW GROOVE ELEVATOR DOORSILL

(71) Applicant: Otis Elevator Company, Farmington, CT (US)

(72) Inventors: Mitsuhiro Ichihara, Narita (JP); Shintarou Saeki, Tomisato (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 7 days.

(21) Appl. No.: 16/912,147

(22) Filed: Jun. 25, 2020

(65) Prior Publication Data

US 2021/0403290 A1 Dec. 30, 2021

(51) Int. Cl.
*B66B 13/30* (2006.01)

(52) U.S. Cl.
CPC ..... *B66B 13/301* (2013.01)

(58) Field of Classification Search
CPC ..... B66B 13/301; B66B 13/30; B66B 13/306
See application file for complete search history.

(56) References Cited

U.S. PATENT DOCUMENTS 1,715,188 A * 5/1929 Bullock ..... B66B 13/301 49/411

FOREIGN PATENT DOCUMENTS

| | | | | | |
|---|---|---|---|---|---|
| CA | 2313090 | A1 | | 6/1999 | |
| EP | 0532347 | A1 | | 3/1993 | |
| JP | 06032571 | A | * | 2/1994 | |
| KR | 20100027294 | A | * | 3/2010 | |
| KR | 101280062 | B1 | | 6/2013 | |
| KR | 20170057986 | A | * | 5/2017 | |
| KR | 101744434 | B1 | * | 6/2017 | |
| WO | WO-0032509 | A1 | * | 6/2000 | ..... B66B 13/301 |
| WO | WO-2015186189 | A1 | * | 12/2015 | ..... B66B 13/301 |
| WO | WO-2016083922 | A1 | * | 6/2016 | ..... B66B 13/301 |

OTHER PUBLICATIONS

Machine Translation of KR 20100027294.*
Machine Translation of WO 2015/186189.*
European Search Report for Application No. 20216416.6; dated Jun. 18, 2021; 8 Pages.

* cited by examiner

*Primary Examiner* — Diem M Tran
(74) *Attorney, Agent, or Firm* — Cantor Colburn LLP

(57) ABSTRACT

A doorsill assembly for an elevator includes a thin sliding member attached to the lower part of an elevator door for guiding opening and closing of the door along a guide groove on the doorsill, and a filling bar arranged in the guide groove so as to close an opening of the guide groove except for the sliding area of the sliding member.

12 Claims, 4 Drawing Sheets

NARROW GROOVE ELEVATOR DOORSILL

TECHNICAL FIELD

The present invention relates generally to an elevator doorsill. In particular, the present invention relates to an elevator doorsill assembly for eliminating the chance of debris or any foreign objects getting caught in a doorsill guide groove.

BACKGROUND ART

An elevator entrance is provided on each floor of a building in which elevator system is installed. Each elevator entrance is provided with an elevator door that can be opened and closed when the elevator car is arrived at the floor. The elevator door has a car door on the side of the elevator car and a landing door on the side of the elevator landing. Generally, each of the car door and landing door has two doors that slide on a car doorsill and a landing doorsill, respectively.

FIG. 1 is a side view showing a landing door 1 with two doors that slide open in unison on a landing doorsill 2, with a landing 3 shown on the right side of the figure. A guide shoe 12 is attached to the lower part of the landing door 1 via a guide shoe plate 11. The doorsill 2 has a guide groove 4 that guides opening and closing of the landing door 1. When the elevator car is arrived at a destination floor, the landing door 1 opens in conjunction with the car door (not shown) in a well-known manner and the guide shoe 12 slides along the guide groove 4 to guide the landing door 1.

Conventionally, if a foreign object such as debris is stuck in such a doorsill guide groove, the door cannot be normally opened and closed, potentially causing an elevator failure.

Furthermore, in some of the elevators, a hole may be provided on the lower surface of the guide groove 4 of the doorsill 2 to remove dirt such as sand on the sill. In that case, if a passenger accidentally drops an item such as key, card, etc. down the guide groove 4 during elevator operation, it may fall into the hoistway.

In addition, a passenger's heel, a wheelchair wheel or the like may be caught in a doorsill guide groove. It would require a service engineer to address these issues on-site.

Accordingly, there is a need for an elevator device that can minimize the potential risk of trapping of foreign objects, tripping, heel catching and dropping items in a doorsill groove.

SUMMARY OF INVENTION

According to one aspect of the present invention, a doorsill assembly for an elevator is disclosed. The doorsill assembly includes a thin sliding member attached to the lower part of an elevator door for guiding opening and closing of the door along a guide groove on the doorsill, and a filling bar arranged in the guide groove so as to close an opening of the guide groove except for the sliding area of the sliding member.

In some embodiments, the sliding member is offset to one side with respect to the longitudinal axis of the guide groove so that the filling bar closes most of the opening of the guide groove, leaving a clearance for the sliding member.

In some embodiments, the sliding member comprises an adjusting shim arranged between the sliding member and its mounting position on the door through a fastening means, in order to position the sliding member in an offset manner.

In some embodiments, the sliding member is formed of a metal, a metal alloy, a hard resin material, a plastic material, or a combination thereof.

In some embodiments, the sliding member is formed of ultra-high molecular weight polyethylene.

In some embodiments, the top surface of the filling bar is mounted flush with the top surface of the doorsill.

In some embodiments, the filling bar has a rectangular cross-sectional shape.

In some embodiments, the filling bar is formed of a metal, a metal alloy, a hard resin material, a plastic material, or a combination thereof.

In some embodiments, the filling bar is formed of stainless steel, iron or aluminum.

In some embodiments, the doorsill assembly further includes a pair of brackets attached to either longitudinal end of the guide groove for fixing the filling bar in the guide groove.

In some embodiments, the filling bar comprises more than one member divided in more than half its entire length.

In some embodiments, the filling bar comprises two members divided in half its entire length.

In some embodiments, the adjacent ends of the members are fixed together by dowel pin.

In some embodiments, wherein the sliding member has a width of less than 4 mm, and the clearance for the sliding member is 4 mm.

In some embodiments, the elevator door is a landing door, and the doorsill is a landing doorsill.

According to another aspect of the present invention, a doorsill assembly for an elevator is disclosed. The doorsill assembly includes a sliding member attached to the lower part of an elevator door for guiding opening and closing of the door along a guide groove on the doorsill. The sliding member is arranged offset to one side with respect to the longitudinal axis of the guide groove. The doorsill assembly includes a filling bar arranged in the guide groove so as to close an opening of the guide groove, leaving a clearance for the sliding member.

In some embodiments, the sliding member comprises an adjusting shim arranged between the sliding member and its mounting position on the door through a fastening means, in order to position the sliding member in an offset manner.

In some embodiments, the sliding member is formed of ultra-high molecular weight polyethylene.

In some embodiments, the top surface of the filling bar is mounted flush with the top surface of the doorsill.

In some embodiments, the filling bar has a rectangular cross-sectional shape.

In some embodiments, the filling bar comprises two members divided in half its entire length.

In some embodiments, the adjacent ends of the two members are fixed together by dowel pin.

These and other aspects of this disclosure will become more readily apparent from the following description and the accompanying drawings, which can be briefly described as follows.

DESCRIPTION OF EMBODIMENTS

Figure 1:
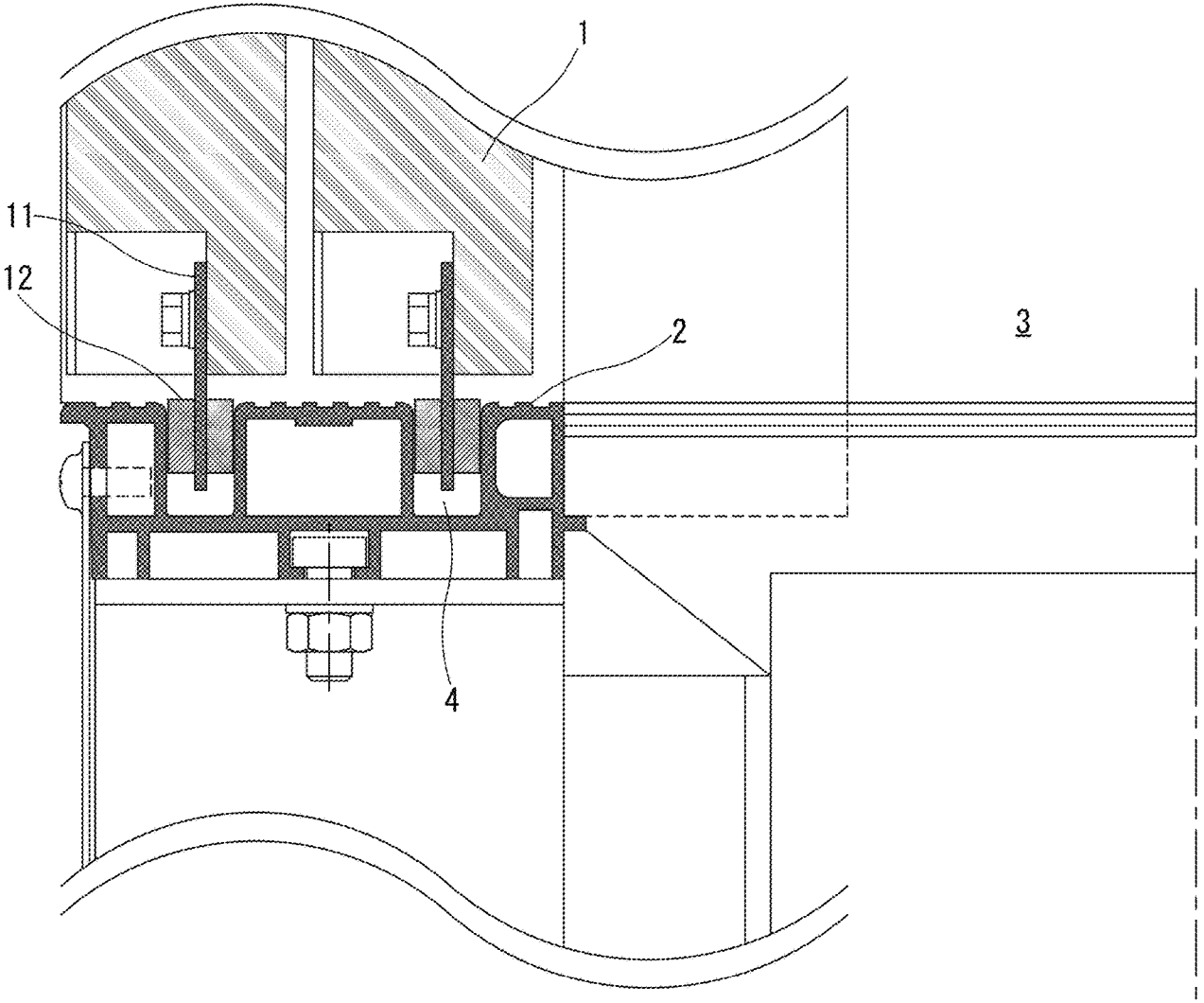
FIG. 1 is a partially-cross sectional side view of an elevator landing door, showing a typical guide shoe and doorsill guide groove.
Figure 2:
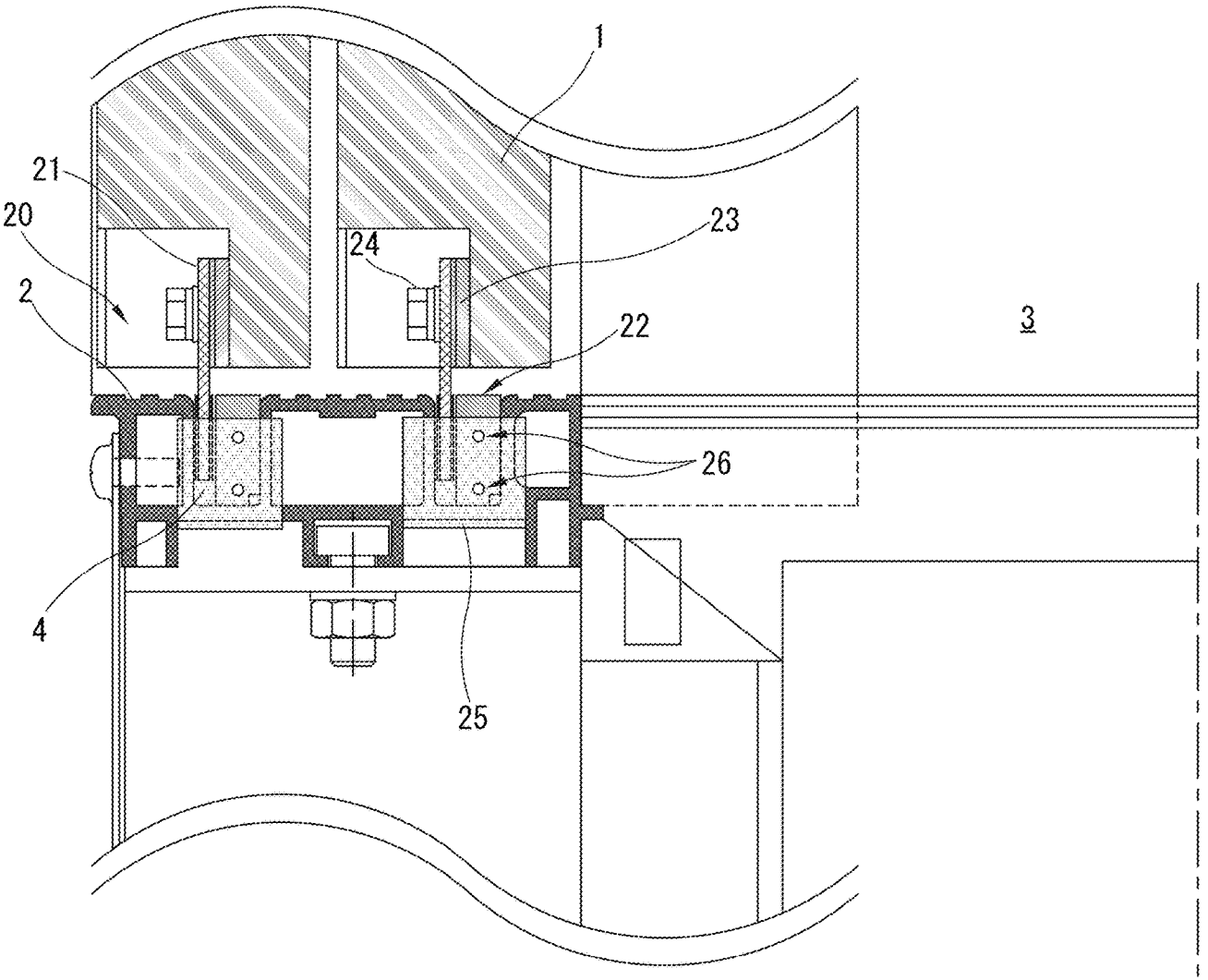
FIG. 2 is a partially-cross sectional side view similar to FIG. 1, including the elevator doorsill assembly in accordance with the present invention.

FIG. 2 is a side view showing a landing door 1 equipped with an elevator doorsill assembly 20 in accordance with the present invention. The landing door 1 basically consists of two doors that slide open in unison on a landing doorsill 2. An elevator landing 3 is shown on the right side of the figure.

The elevator doorsill assembly 20 includes a thin sliding member 21 and a filling bar 22 for the guide groove 4. The sliding member 21 is attached to the lower part of the landing door 1 in parallel with the landing door 1 via fastening means 24 such as bolts. The sliding member 21 is arranged so as to be offset to one side with respect to the longitudinal axis of the guide groove 4. The filling bar 22 is provided in the doorsill guide groove 4 so as to close an opening of the guide groove 4 except for the sliding area of the sliding member 21.

In one example, the entire width of the guide groove 4 of a typical doorsill is about 12 mm, the width of the sliding member 21 according to the present invention is less than 4 mm, and the width of the filling bar 22 according to the present invention is about 8 mm. However, it should be understood that any width of the filling bar 22 can be used to fit into a guide groove 4 of any width, leaving a clearance of about 4 mm for the sliding member 21.

In one example, the thin sliding member 21 is made of a high-strength synthetic resin material having excellent impact resistance and abrasion resistance. Preferably, the sliding member 21 is made of ultra-high molecular weight polyethylene. However, the sliding member 21 may be formed of other material such as metal, a metal alloy, a hard resin material, a plastic material, or a combination thereof.

As shown in FIG. 2, the thin sliding member 21 is offset to one side (offset to the hoistway side) with respect to the longitudinal axis of the guide groove 4 so that the filling bar 22 can close most of the opening of the guide groove 4. In order to position the sliding member 21 in an offset manner, adjusting shim 23 may be provided between the sliding member 21 and its mounting position on the lower part of the landing door 1. The adjusting shim 23 may be attached via the fastening means 24.

The filling bar 22 may be formed of any material such as metal, a metal alloy, a hard resin material, a plastic material, or a combination thereof. In one example, the filling bar 22 is made of a metal material such as stainless steel, iron, aluminum, etc. It should be understood that the filling bar 22 may be made of any material having excellent impact resistance and abrasion resistance. The filling bar 22 is arranged in the guide groove 4 along the doorsill 2 so as to close an opening of the guide groove 4, leaving the sliding range of the sliding member 21. The top surface of the filling bar 22 is mounted flush with the top surface of the doorsill 2 to prevent passengers from tripping.

Figure 3:
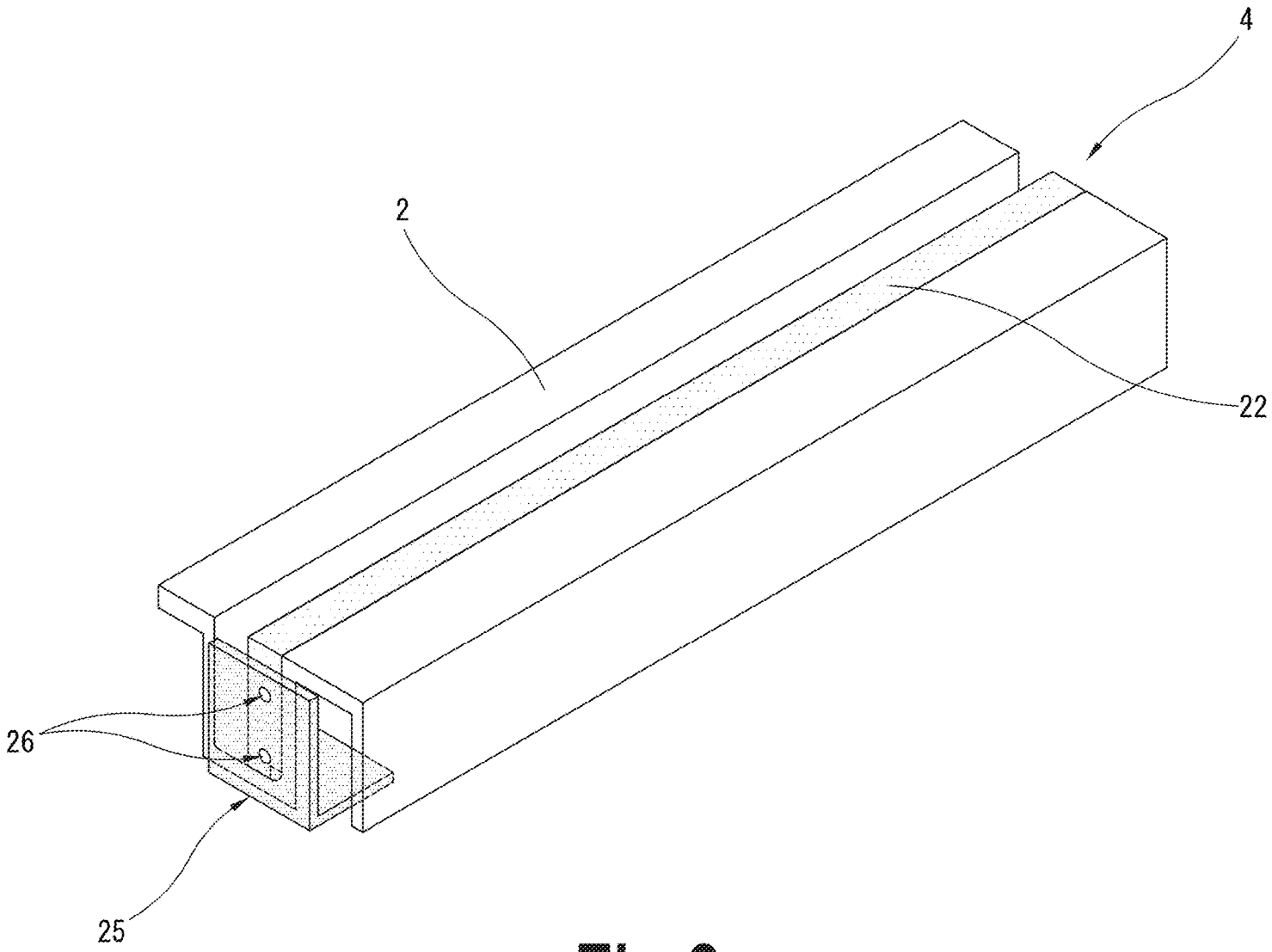
FIG. 3 is a perspective view of the filling bar of FIG. 2.

As shown in FIGS. 2 and 3, the filling bar 22 has a smaller cross-sectional shape than the guide groove 4. In one example, the filling bar 22 is a rod-shaped member having a rectangular cross-sectional shape that comes into contact with the sliding member 21 during elevator door operation. The guide surface of the filling bar 22 opposed to the sliding member 21 is generally parallel to the guide surface of the guide groove 4. However, it should be understood that the filling bar 22 may have various cross-sectional shapes such as a partially tapered cross section, a cross section with rounded edges on the side adjacent to the sliding member 21, etc., so as to minimize the contact area with the sliding member 21.

When attaching such a filling bar 22 to the guide groove 4 of the doorsill 2, a pair of L-shaped brackets 25 as shown in FIG. 3 are installed at either longitudinal end of the guide groove 4 by welding or fasteners such as bolts. Subsequently, both ends of the filling bar 22 are fixed to the corresponding brackets 25 using a fixture 26 such as bolts, screws, etc.

With such a configuration, a flat floor surface closed by the filling bar 22 is formed in the area of the conventional guide groove 4, leaving extremely narrow clearance for the sliding member 21. Thus, it is ensured that the potential risk of trapping of foreign objects, tripping, heel catching and dropping items in the guide groove 4 are minimized. Furthermore, the relatively small contact area between the sliding member 21 and the filling bar 22 enables smooth opening and closing of the door 1 while reducing noise during elevator door operation.

Figure 4:
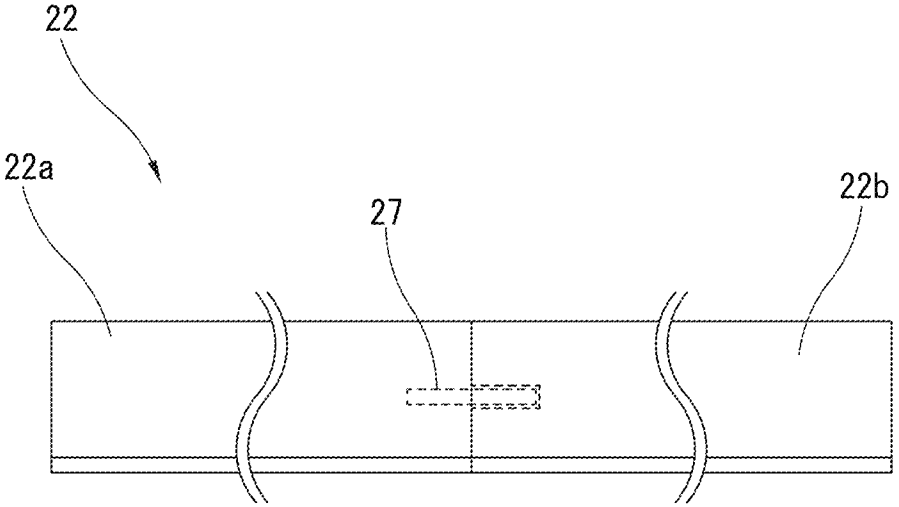
FIG. 4 illustrates another example of the filling bar of FIG. 3.

FIG. 4 is a front view showing another example of the filling bar 22 of the present invention. The filling bar 22 comprises two rod-shaped members 22*a*, 22*b* divided in half in the longitudinal direction so that each member 22*a*, 22*b* forms one-half the length of the doorsill guide groove 4. When attaching the filling bar 22 to the guide groove 4 of the doorsill 2, a pair of L-shaped brackets 25 as shown in FIG. 3 are installed at either longitudinal end of the guide groove 4 by welding or fasteners such as bolts. Subsequently, as shown in FIG. 4, two adjacent ends of the rod-shaped members 22*a*, 22*b* are fixed together by a dowel pin 27 to form one filling bar 22 such that the dowel pin 27 arranged on one of the two adjacent ends is press fit into the corresponding dowel hole in the other end. Finally, two longitudinal ends of the filling bar 22 are fixed to the corresponding brackets 25 using a fixture 26 such as bolts, screws, etc.

By dividing the filling bar 22 in half, it enables easier installation in a difficult-to-install location, especially in a doorsill guide groove of an existing elevator. It should be understood that the filling bar 22 may be composed of a plurality of rod-shaped members.

Alternatively or additionally, each bracket 25 may include a mounting portion having a shape complementary to a connector formed at the corresponding ends of the filling bar 22. Each connector may be engaged with the mounting portion of the corresponding bracket 25. The complementary mounting structure of the connector of the filling bar 22 and the mounting portion of the bracket 25 may be any structure, such as a combination of recess and projection, hook and fastener, etc. Alternatively, the filling bar 22 may be attached to the guide groove 4 using any fixing means, including but not limiting to clamping, welding, thread fastening, and plug-in connection with or without the bracket 25.

According to the present invention, it is ensured that the potential risk of trapping of foreign objects, tripping on a doorsill and dropping items in an elevator doorsill guide groove are minimized Above all, the potential risk of heel catching and wheelchair accidents related to a doorsill guide groove can be eliminated.

Furthermore, the filling bar 22 can be attached only by accessing from the upper part of the doorsill guide groove 4 so that it is not necessary to remove or replace the doorsill 2 when installing the guide shoe plate 21 and the filling bar 22. Therefore, the doorsill assembly 20 of the present invention can not only be easily installed in a newly installed elevator, but also can be retrofitted to an existing elevator in a cost effective manner. In addition, with such a configuration, trouble and malfunction of the elevator system due to installation on the doorsill can be eliminated while reducing unnecessary labor of service engineer.

Although the embodiments have been described with respect to the landing doorsill, it should be understood that the doorsill assembly of the present invention may be provided in a car doorsill.

Furthermore, although the embodiments have been described with reference to the drawings, various modifications are applicable. For example, the present invention may be applied to any number of door panels. In addition, the sliding member of the present invention may not be arranged in an offset manner. For example, the sliding member may be arranged in the center of the guide groove and two elongated filling bars may be arranged in the guide groove accordingly.

While the present invention has been particularly shown and described with reference to the exemplary embodiments as illustrated in the drawings, it will be recognized by those skilled in the art that various modifications may be made without departing from the spirit and scope of the invention as disclosed in the accompanying claims.

What is claimed is:

1. A doorsill assembly for an elevator, comprising:

a sliding member attached to an elevator door for guiding opening and closing of the elevator door along a guide groove on the doorsill; and a filling bar arranged in the guide groove so as to close an opening of the guide groove except for the sliding area of the sliding member;

wherein the filling bar comprises more than one member;

wherein adjacent ends of the more than one member are fixed together by dowel pin.

2. A doorsill assembly of claim 1, wherein the sliding member is offset to one side with respect to a longitudinal axis of the guide groove so that the filling bar closes most of the opening of the guide groove, leaving a clearance for the sliding member.

3. A doorsill assembly of claim 1, wherein the sliding member comprises an adjusting shim arranged between the sliding member and its mounting position on the elevator door through a fastening means, in order to position the sliding member in an offset manner.

4. A doorsill assembly of claim 1, wherein the sliding member is formed of a metal, a metal alloy, a hard resin material, a plastic material, or a combination thereof.

5. A doorsill assembly of claim 1, wherein the sliding member is formed of polyethylene.

6. A doorsill assembly of claim 1, wherein the filling bar has a rectangular cross-sectional shape.

7. A doorsill assembly of claim 1, wherein the filling bar is formed of a metal, a metal alloy, a hard resin material, a plastic material, or a combination thereof.

8. A doorsill assembly of claim 1, wherein the filling bar is formed of stainless steel, iron or aluminum.

9. A doorsill assembly of claim 1, further comprising a pair of brackets attached to either longitudinal end of the guide groove for fixing the filling bar in the guide groove.

10. A doorsill assembly of claim 1, wherein the filling bar is divided in more than half its entire length.

11. A doorsill assembly of claim 1, wherein the filling bar comprises two members divided in half its entire length.

12. A doorsill assembly of claim 1, wherein the elevator door is a landing door, and the doorsill is a landing doorsill.

* * * * *